United States Patent [19]

Norrström et al.

[11] Patent Number: 4,534,397

[45] Date of Patent: Aug. 13, 1985

[54] METHOD FOR PRODUCING CHEMIMECHANICAL HIGH YIELD PULP USING AN OXYGEN ALKALI TREATMENT FOLLOWED BY AN OXYGEN MECHANICAL DEFIBRATION

[75] Inventors: Hans Norrström, Täby; Kristina Idner, Dandery, both of Sweden

[73] Assignee: AGA Aktiebolag, Lidingo, Sweden

[21] Appl. No.: 486,872

[22] Filed: Apr. 20, 1983

Related U.S. Application Data

[63] Continuation of Ser. No. 294,128, Aug. 19, 1981, abandoned, which is a continuation of Ser. No. 164,863, Jul. 1, 1980, abandoned.

[30] Foreign Application Priority Data

Jul. 10, 1979 [SE] Sweden ..... 7905990

[51] Int. Cl.[3] ..... D21C 1/02; D21C 1/16; D21C 3/26

[52] U.S. Cl. ..... 162/23; 162/28; 162/65

[58] Field of Search ..... 162/23, 20, 24, 28, 162/25, 90, 65, 19

[56] References Cited

U.S. PATENT DOCUMENTS 4,288,288 9/1981 Fleck et al. ..... 162/23

*Primary Examiner*—Steve Alvo

*Attorney, Agent, or Firm*—Pollock, Vande Sande & Priddy

[57] ABSTRACT

A method for producing pulp in high yield in order to achieve strength improvement and increased absorption of liquid in the end-product, the paper, whereby a lignocellulosic material is treated in liquid or gas phase in alkalic media, the treatment thereby being performed in the presence of oxygen gas. The material is then mechanically defibrated in the presence of oxygen. It is possible to perform the treatment on the material when in the form of logs, chips, shavings as well as on completely or partly separated fibres. The treatment is performed in such a combination of treatment time, temperature, charge of chemicals, oxygen gas pressure and pulp consistency that pulp yield, i.e. the ratio between the produced amount of fibre and the charged amount material, is higher than 80%, preferably within the range of 80–95%.

3 Claims, 2 Drawing Figures

METHOD FOR PRODUCING CHEMIMECHANICAL HIGH YIELD PULP USING AN OXYGEN ALKALI TREATMENT FOLLOWED BY AN OXYGEN MECHANICAL DEFIBRATION

This application is a continuation of U.S. Ser. No. 294,128, filed Aug. 19, 1981, now abandoned; which is a continuation of U.S. Ser. No. 164,863, filed 7/1/80 now abandoned.

This invention relates to a method in the processing of high yield pulp in order to achieve strength improvements and/or increased absorption of liquid in the end-product, the paper, whereby a lignocellulosic material is treated in liquid or gas phase in an alkalic media.

It is well known that mechanical pulps in high yields may be modified by oxidation, sulphonation or by delignification and thereby affect the yield and other pulp properties.

It is well known from the literature that treatment of mechanical pulps with oxygen gas is possible. All these methods are however, related to the production of pulp in a yield range more comparable to chemical pulps, i.e. a yield of about 50–65%. This production of chemical pulps (yield level 50–65%) through treatment of chips with oxygen gas in alkalic media is already described in many works, for example in the publication Tappi, Vol 61, No. 12, December 1978, p 40–42, "Oxygen pulping of hardwoods and softwoods in oxygen-rich conditions". At the production of chemical pulps most of the lignin present in the wood material is dissolved whereafter it is possible during the following treatment with bleaching components to gain very bright and strong paper.

The process described in the present patent application is related to the production of pulp in very high yield (80–95%) and thereby minimizing the loss of substances. This high yield and high retention of lignin (minimized substance loss) is achieved by a suitable combination of treatment time, treatment temperature and the addition of chemicals as will be described hereinafter. These pulps normally have very low strength properties and low brightness and have thereby limited use. By means of the treatment with oxygen gas in alkaline pulping liquor it is possible to gain good strength and improvements in brightness without any loss of substances.

According to the present invention it is possible to produce high yield pulp showing very good strength properties and/or increased absorption of liquid in the end-product. The present invention relates to a treatment of the lignocellulosic material in the presence of oxygen gas but also means to provide the treatment in such a combination of treatment time, temperature, charge of chemicals, pressure of oxygen and pulp consistency (the ratio of weight between fibre material and total material including amount of liquid) that a pulp yield (ratio of produced amount of fibre and the charge amount of material) higher than 80%, preferably within the range of 80–95%, is gained. The treated wood material may be in the form of wood logs, chips and shavings as well as in the form of completely or partly separated fibres. The treatment may be performed in one or several successive steps, such as pretreatment step, defibration steps and posttreatment steps.

Between the treatment steps it is possible to place further process steps, such as washing, further defibration or other chemical treatments. Further it is possible to perform the treatment in 60 minutes or less with 1–200 kg alkali per ton of dry pulp. The treatment temperature may vary between 20° C. and 200° C. The pressure of oxygen during the treatment is in the range of 1–10 kg/cm$^2$. The alkali source is used for the treatment extend such chemicals as NaOH, $Na_2CO_3$, $Mg(OH)_2$ and $MgCO_3$. The pulp consistency may vary between 1–50%. The treatment may be performed in the presence of catalysts or inhibitors such as metals, metal complex or chelating agents.

The invention will be disclosed more in detail with reference to the attached drawings.

Figure 1:
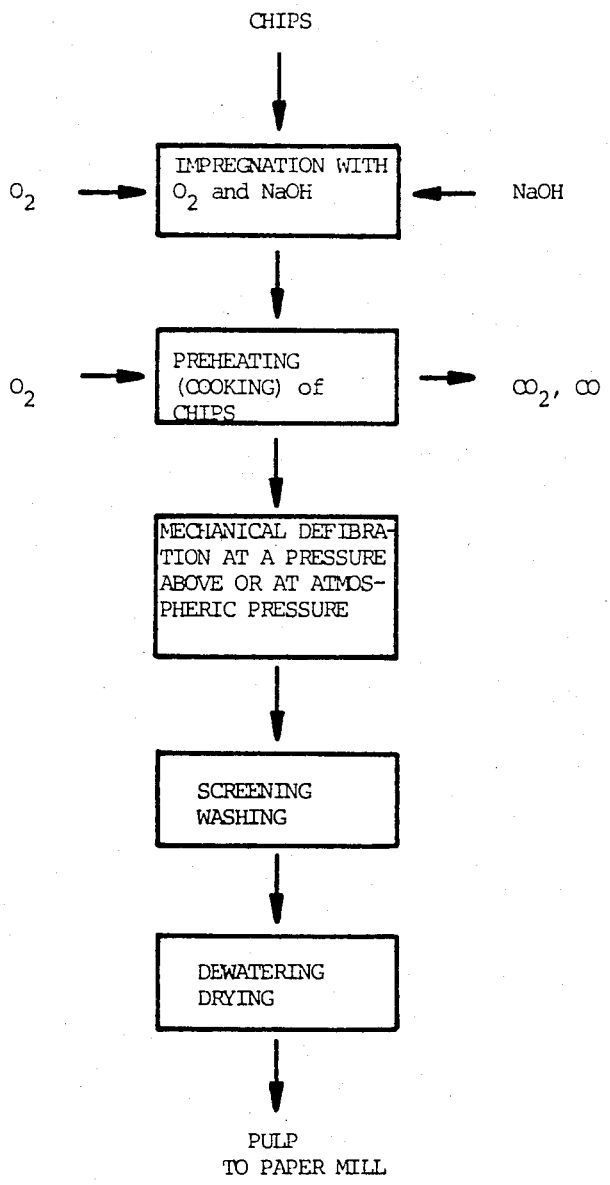
FIG. 1 shows schematically a plan view of a treatment plant for the production of high pulp yield with pretreatment by means of impregnation and preheating in the presence of alkali and oxygen gas under pressure or at atmospheric pressure.
Figure 2:
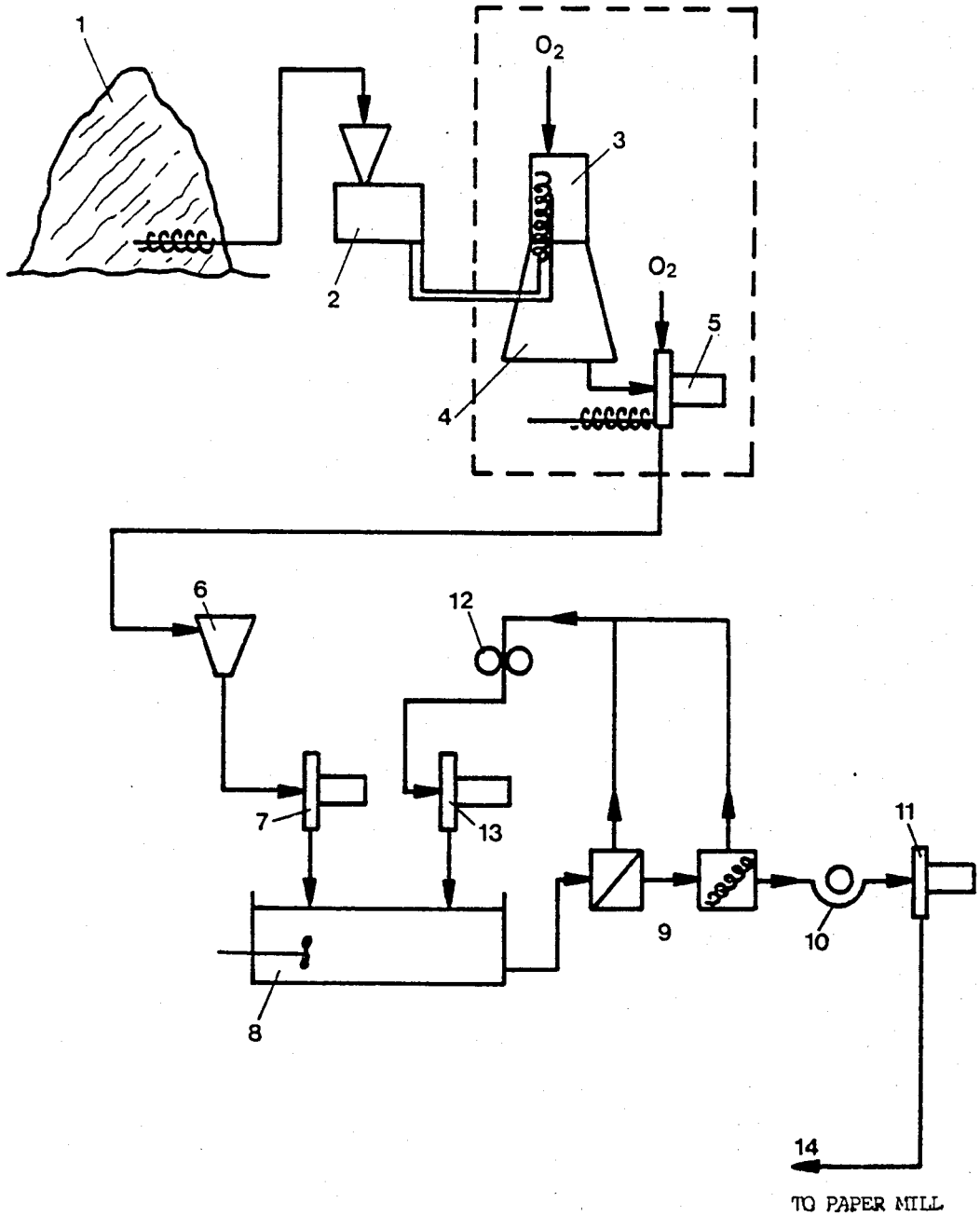
FIG. 2 shows schematically an example of a treatment plant where the described treatment is used.

The chips 1 are transported via a chip washing 2 to an impregnating vessel 3, the chips are impregnated with NaOH, which is saturated with oxygen gas by means of an over pressure up to 20 kg/cm$^2$ (2MPa) which is maintained during the impregnation. The chips thereafter are transported to a preheating vessel 4, in which the treatment time, temperature and oxygen pressure is free to be used in an optimum way and whereby it is technically suitable that the concentration of developed decomposition products such as $CO_2$, CO may be controlled. Since the oxidation reactions are exothermic this preheating vessel may be equipped for temperature control.

Alternatively it is possible to combine the impregnation and the preheating to one operation. It is then a practical advantage to arrange this process step in such a manner that it is possible to maintain a continuous through flow of impregnation liquid. In order to achieve a suitable composition of the impregnation liquid it is possible to regenerate this alternatively by adding some fresh impregnation liquid before it is pumped back to the combinated process step. After the pretreatment the partly delignified and softened chips are transported to a disc refiner 5, where the mechanical defibration is performed by simultaneously adding oxygen gas at a relatively low input of energy. It is thereby possible to perform the defibration at a pressure above or at atmospheric pressure, whereafter the processed pulp can be cleaned, dewatered and dried in a conventional manner. Alternatively the processed pulp can be directly transported to the integrated paper mill where the final treatment can be performed.

After the discrefiner 5, the pulp is pumped through the disc refiner 7 after other conventional steps (indicated collectively at 6). It is thereafter pumped to a tank 8 for settling. The pulp is there diluted to about 2% consistency whereafter it is pumped through a cleaning device 9 and a thickener 10 and finally is, transported, as indicated at 11, to the paper mill 14. From the cleaning device the rejects are brought back to the process via thickener 12 and a so called reject refiner 13 in a well known way.

What we claim is:

1. A method for producing chemimechanical pulp at high yield, where yield is defined as the amount of pulp obtained in relation to the input of raw material, in order to achieve strength improvement and increased absorption of liquid in end-product paper, wherein lignocellulosic material, selected from the group consisting of raw materials in the form of logs, chips, and shavings, is treated in alkaline pulping liquor, characterized in that the treatment is performed in the presence of oxygen gas and is performed in such a combination of treatment time, temperature, charge of chemicals, oxygen pressure and consistency of lignocellulosic material, that a pulp yield within the range of 80–95%, is obtained, the method further characterized in that the treatment is performed:

(a) with 1–200 Kg of alkali per ton dry lignocellulosic material, (b) at a treatment temperature between 20° and 200° C., (c) at an oxygen gas pressure of 1–10 kg/cm$^2$, (d) with a source of alkali selected from the group consisting of NaOH, $Na_2CO_3$, $Mg(OH)_2$, and $MgCO_3$, (e) at a treatment time no longer than 60 minutes, the treatment followed by the steps of, (f) mechanically defibrating the material, and (g) adding $O_2$ to the material as it is defibrated; steps (a) through (g) thereby minimizing the loss of substances.

2. A method as claimed in claim 1, characterized in that the treatment is peformed in one or several successive steps such as for instance pretreatment, defibration step and post treatment step.

3. A method as claimed in claim 2, characterized in that it is possible to place further process steps between the treatment steps such as washing, defibration or a chemical treatment.

* * * * *